US008979513B2

(12) United States Patent
Yen et al.

(10) Patent No.: US 8,979,513 B2
(45) Date of Patent: Mar. 17, 2015

(54) LEAD WIRE ENGAGING STRUCTURE AND ELECTRIC APPARATUS

(75) Inventors: Kevin Yen, Nagano (JP); Jiro Watanabe, Nagano (JP); Hiromitsu Kuribayashi, Nagano (JP); Shigekazu Mitomo, Nagano (JP)

(73) Assignee: Sanyo Denki Co., Ltd., Tokyo (JP)

( * ) Notice: Subject to any disclaimer, the term of this patent is extended or adjusted under 35 U.S.C. 154(b) by 660 days.

(21) Appl. No.: 13/268,018

(22) Filed: Oct. 7, 2011

(65) Prior Publication Data

US 2012/0087813 A1 Apr. 12, 2012

(30) Foreign Application Priority Data

Oct. 7, 2010 (JP) ..... 2010-227433

(51) Int. Cl.
*F04B 35/04* (2006.01)
*F04D 25/06* (2006.01)
*F04D 29/42* (2006.01)

(52) U.S. Cl.
CPC ..... *F04D 25/0693* (2013.01); *F04D 25/0613* (2013.01); *F04D 29/4206* (2013.01)
USPC ..... 417/423.14

(58) Field of Classification Search
CPC ..... F04D 25/0693
USPC ..... 417/423.1–423.14, 424.1, 424.2; 72/264; 140/93 R, 147, 149; 211/181.1; 199/3, 4; 445/69; 157/1.14; 340/854.9, 340/855.1, 855.2; 174/40 CC, 72 A, 73.1, 174/481; 310/71; 439/452; 361/679.01, 361/679.02, 679.47, 679.48, 679.49, 679.5, 361/679.51; 362/391
See application file for complete search history.

(56) References Cited

U.S. PATENT DOCUMENTS 2,651,301 A * 9/1953 Allyn et al. ..... 600/248
6,388,196 B1 5/2002 Liu et al.

(Continued)

FOREIGN PATENT DOCUMENTS

EP 1754862 2/2007
JP 56-002288 6/1954

(Continued)

OTHER PUBLICATIONS

Japanese Office action mailed Mar. 18, 2014.

(Continued)

*Primary Examiner* — Peter J Bertheaud
*Assistant Examiner* — Dnyanesh Kasture
(74) *Attorney, Agent, or Firm* — Rankin, Hill & Clark LLP

(57) ABSTRACT

A lead wire engaging structure includes a first engaging portion and a second engaging portion. One end of the first engaging portion and one end of the second engaging portion are integrally provided at a first mounting portion integrally provided at a second casing wall portion. The first engaging portion forms a first gap between the first engaging portion and the second casing wall portion, and engages four lead wires in cooperation with the second casing wall portion. The first gap allows the four lead wires to pass therethrough. The second engaging portion forms a second gap between the second engaging portion and the first engaging portion. The second gap allows the four lead wires to pass therethrough. The other end portion of the first engaging portion and the other end portion of the second engaging portion are coupled to each other by a coupling portion.

3 Claims, 21 Drawing Sheets

(56) References Cited

U.S. PATENT DOCUMENTS

| | | | | |
|---|---|---|---|---|
| 2002/0025261 | A1 | 2/2002 | Kudo et al. | |
| 2004/0253128 | A1 | 12/2004 | Cheng et al. | |
| 2005/0202713 | A1 | 9/2005 | Morishitahara | |
| 2005/0225939 | A1 | 10/2005 | Otsuki et al. | |
| 2007/0041857 | A1 | 2/2007 | Fleig | |
| 2007/0280840 | A1* | 12/2007 | Sugiyama et al. | 417/423.5 |
| 2009/0103264 | A1* | 4/2009 | Hung et al. | 361/697 |
| 2011/0097226 | A1 | 4/2011 | Nakamura et al. | |

FOREIGN PATENT DOCUMENTS

| | | |
|---|---|---|
| JP | 59-127284 | 8/1984 |
| JP | 61-76996 | 5/1986 |
| JP | 11-230083 | 8/1999 |
| JP | U3070547 | 8/2000 |
| JP | 2002-61596 | 2/2002 |
| JP | 2005-256749 | 9/2005 |
| JP | 2005-303015 | 10/2005 |
| JP | 3128352 | 12/2006 |
| JP | 2010-007545 | 1/2010 |

OTHER PUBLICATIONS

European Search Report dated Aug. 11, 2014, 8 pages.

Office action filed in Chinese application No. 201110302195.1 dated Nov. 24, 2014.

* cited by examiner

LEAD WIRE ENGAGING STRUCTURE AND ELECTRIC APPARATUS

BACKGROUND OF THE INVENTION

1. Technical Filed

The present invention relates to a lead wire engaging structure configured to engage lead wires at an electric apparatus casing, and also relates to an electric apparatus.

2. Background Art

Japanese Patent Application Publication No. 11-230083 (JP11-230083A) discloses a centrifugal fan (electric apparatus) in which a groove portion is formed in an outer wall of a wall portion opposite to a suction port of a casing to receive a plurality of lead wires in the groove portion. A nail-like projection extends along an opening portion of the groove portion to prevent the lead wires from coming out of the groove portion.

Japanese Patent Application Publication No. 2005-303015 (JP2005-303015A) discloses a lead wire engaging structure in which lead wires are received in a groove portion provided in a web of an axial flow fan, and in which the lead wires extending out of the groove portion are engaged at a hook provided on an outer wall of a casing.

Japanese Patent Application Publication No. 2010-7545 (JP2010-007545A) discloses a lead wire engaging structure in which lead wires are housed in a groove portion provided in a web of an axial flow fan, and in which the lead wires extending out of the groove portion are engaged with lead wire engaging portions provided on an outer wall of a casing.

In the conventional lead wire engaging structures, when the lead wires receive a force in the direction of pushing the lead wires along the longitudinal direction of the lead wires into the electric apparatus casing, the lead wires may be partially raised at portions located on the side where the lead wires are drawn out with respect to the lead wire engaging portion. If the electric apparatus is installed with the lead wires thus raised, the raised portions of the lead wires may hinder installation of the electric apparatus, or may cause noise.

SUMMARY OF THE INVENTION

An object of the present invention is to provide a lead wire engaging structure in which lead wires are not raised even if the lead wires receive a force in the direction of pushing the lead wires into the electric apparatus casing, and to provide an electric apparatus including the lead wire engaging structure.

Another object of the present invention is to provide a lead wire engaging structure in which lead wires extending from the lead wire engaging structure do not hinder installation of an electric apparatus, and to provide an electric apparatus including the lead wire engaging structure.

The present invention is directed to a lead wire engaging structure configured to engage one or more lead wires at an electric apparatus casing including a first casing wall portion from which the one or more lead wires are led out and a second casing wall portion continuously formed with the first casing wall portion and extending in an intersecting direction intersecting a direction in which the first casing wall portion extends. The one or more lead wires have an insulating coating, and are engaged at the second casing wall portion. If the electric apparatus is a fan, for example, the electric apparatus casing is a casing having an air channel of the fan. The lead wire engaging structure according to the present invention includes a first engaging portion and a second engaging portion. The first engaging portion is fixed to the electric apparatus casing to form a first gap between the first engaging portion and the second casing wall portion and to engage the one or more lead wires in cooperation with the second casing wall portion. The first gap allows the one or more lead wires to pass therethrough. The second engaging portion is fixed to the electric apparatus casing or the first engaging portion to form a second gap between the second engaging portion and the first engaging portion. The second gap allows the one or more lead wires to pass therethrough. In the lead wire engaging structure according to the present invention, the one or more lead wires are bent at an angled portion between the first casing wall portion and the second casing wall portion and then routed to pass through the first gap and then through the second gap to engage the one or more lead wires at the electric apparatus casing. In the lead wire engaging structure according to the present invention, when the one or more lead wires receive a force that pushing the lead wires in the longitudinal direction thereof into the casing, portions of the lead wires located in the second gap are moved toward the second casing wall portion. Then, portions of the lead wires located between the second gap and the first gap are brought into abutment with the second casing wall portion. The force presses the lead wires against the second casing wall portion, but does not press out the portions of the lead wires held in the first gap between the first engaging portion and the second casing wall portion. Therefore, according to the lead wire engaging structure of the present invention, the lead wires are not raised even if the lead wires receive a force in the direction of pushing the lead wires into the casing.

The first casing wall portion may include a groove portion formed to open toward an outer wall surface of the first casing wall portion and an outer wall surface of the second casing wall portion and to receive a part of the one or more lead wires. Preferably, the first engaging portion and the second engaging portion are entirely located in a space located in an extending direction in which the second casing wall portion extends with respect to an imaginary plane including the outer wall surface of the first casing wall portion, and are shaped such that a lead wire passage space allowing the one or more lead wires to pass therethrough is defined between the second engaging portion and the imaginary plane. According to the above structure, the lead wires does not hinder installation of the electric apparatus in installing the electric apparatus such that the first casing wall portion of the electric apparatus casing contacts the installation surface. By forming the lead wire passage space allowing the lead wires to pass therethrough between the second engaging portion and the imaginary plane, in particular, the lead wires extending out of the lead wire engaging structure do not hinder installation of the electric apparatus.

As in a first aspect of the present invention, the second casing wall portion may include an extending portion to which one end portion of the first engaging portion and one end portion of the second engaging portion are fixed. By providing such extending portion, the first engaging portion and the second engaging portion can be easily provided. The other end portion of the first engaging portion and the other end portion of the second engaging portion, which are located in the extending direction, may be coupled to each other by a coupling portion. The second engaging portion may include one slit formed at a center area of the second engaging portion and allowing one of the lead wires to pass therethrough while the insulating coating of the one lead wire is deformed by compression in the slit. This configuration allows the one or more lead wires having passed through the first gap to be inserted into the second gap through the slit. The slit is significantly effective if the lead wires are long. Because the slit is sized to allow one of the lead wires to pass therethrough only while the insulating coating of the one lead wire is deformed by compression in the slit, the one or more lead wires inserted into the second gap do not come out of the second gap unless the lead wires are intentionally pulled out through the slit. Thus, this configuration facilitates engagement of the lead wires, and prevents the lead wires from slipping out.

As in a second aspect of the present invention, the second casing wall portion may include an extending portion to which one end portion of the first engaging portion and one end portion of the second engaging portion are fixed, and the other end portion of the first engaging portion and the other end portion of the second engaging portion may be not fixed to act as a free end portion. After the one or more lead wires pass through the first gap, the one or more lead wires are inserted into the second gap between the first engaging portion and the second engaging portion from a space between the free end portions of the first and second engaging portions to prevent the one or more lead wires from slipping out of the first gap. This configuration provides a simple structure.

Further, as in a third aspect of the present invention, the second casing wall portion may include an extending portion to which one end portion of the first engaging portion is fixed and which forms a third gap between the extending portion and one end portion of the second engaging portion. The third gap allows the one or more lead wires to pass therethrough. The other end portion of the first engaging portion and the other end portion of the second engaging portion may be coupled to each other by a coupling portion. After the one or more lead wires pass through the first gap, the one or more lead wires are inserted into the second gap between the first engaging portion and the second engaging portion through the third gap. Because the third gap is formed between the extending portion and an end portion of the second engaging portion, the one or more lead wires inserted into the first gap do not slip out of the first gap during an engaging operation.

In both of the second and third aspects of the present invention, the second engaging portion may integrally be provided with a projection extending toward the imaginary plane. The projection prevents the one or more lead wires passing through the second gap and extending along the imaginary plane from coming off from the second engaging portion.

The present invention may also be implemented as an electric apparatus including a lead wire engaging structure. The electric apparatus according to the present invention includes an electric apparatus casing including: a first casing wall portion having an outer wall surface to be disposed in contact with an installation surface; a second casing wall portion continuously formed with the first casing wall portion and extending in an intersecting direction intersecting a direction in which the first casing wall portion extends; and a third casing wall portion formed continuously with the second casing wall portion and disposed opposite to the first casing wall portion. An electric device is housed in the electric apparatus casing. When the electric apparatus is a fan, the electric device is a motor and an impeller. One or more lead wires are connected to the electric device and extend out of the first casing wall portion. A groove portion is formed in the first casing wall portion of the electric apparatus casing to open toward an outer wall surface of the first casing wall portion and an outer wall surface of the second casing wall portion and to receive a part of the one or more lead wires. The electric apparatus includes a lead wire engaging structure provided to the second casing wall portion to engage the one or more lead wires extending out of the groove portion. The lead wire engaging structure is configured as discussed above.

The electric apparatus may be a centrifugal fan including a suction port formed in the third casing wall portion of the electric apparatus casing and a discharge port formed in the second casing wall portion. In the centrifugal fan, the second casing wall portion includes first and second straight wall portions continuously formed with the discharge port and disposed opposite to each other with a predetermined gap therebetween, and an arcuate wall portion continuously formed with the first and second straight wall portions. A first portion of the arcuate wall portion that is adjacent to one of the first and second straight wall portions that is the longer is integrally provided with a mounting portion, which corresponds to the extending portion, including one or more screw holes each allowing passage of a mounting screw for fixing the electric apparatus casing to the installation surface. The first and second engaging portions are integrally provided at the mounting portion. By adopting such a configuration in the centrifugal fan, the overall size of the centrifugal fan can be made compact even if a lead wire engaging structure is provided.

DESCRIPTION OF THE PREFERRED EMBODIMENTS

Figure 1:
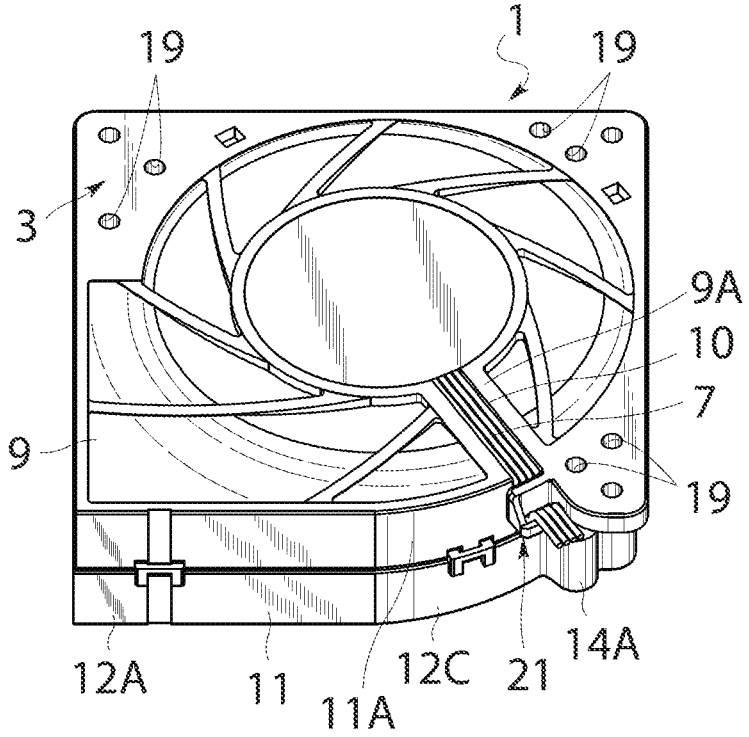
FIG. 1 is a perspective view showing the back side of a centrifugal fan according to a first embodiment of the present invention.
Figure 2:
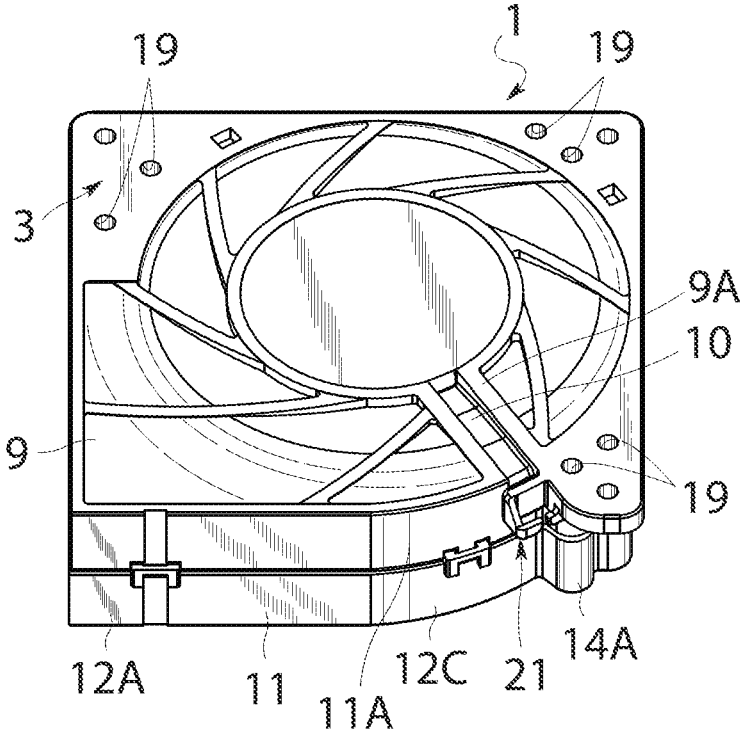
FIG. 2 is a perspective view showing the back side of the centrifugal fan according to the first embodiment from which lead wires have been removed.
Figure 3:
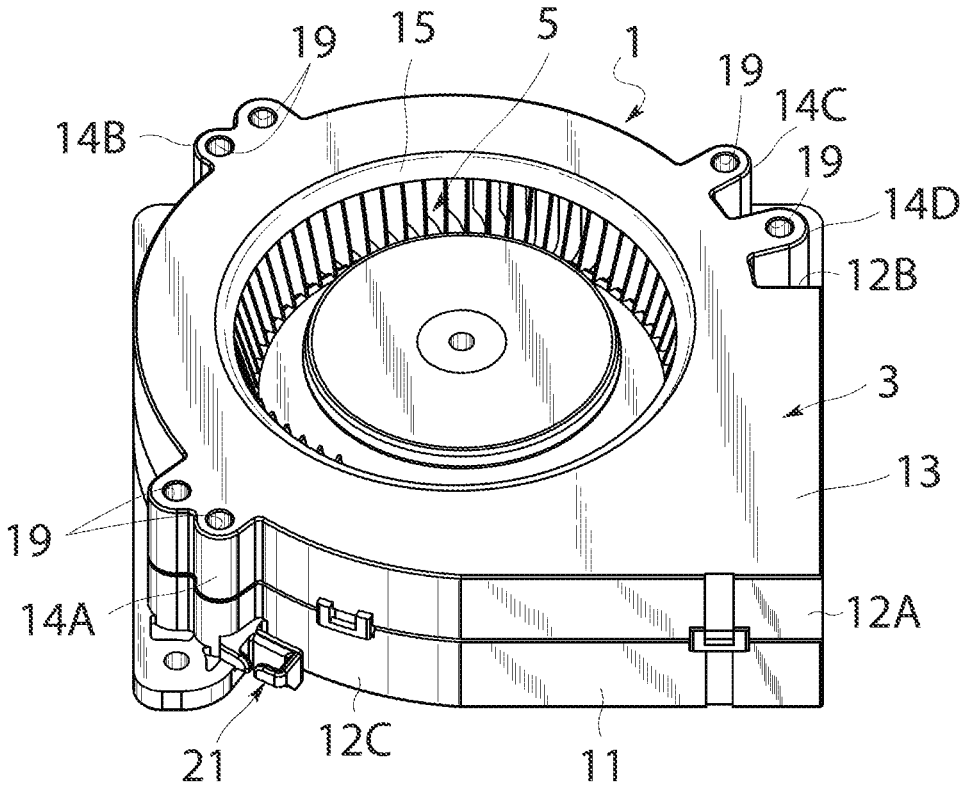
FIG. 3 is a perspective view showing the front side of the centrifugal fan according to the first embodiment from which lead wires have been removed.
Figure 4:
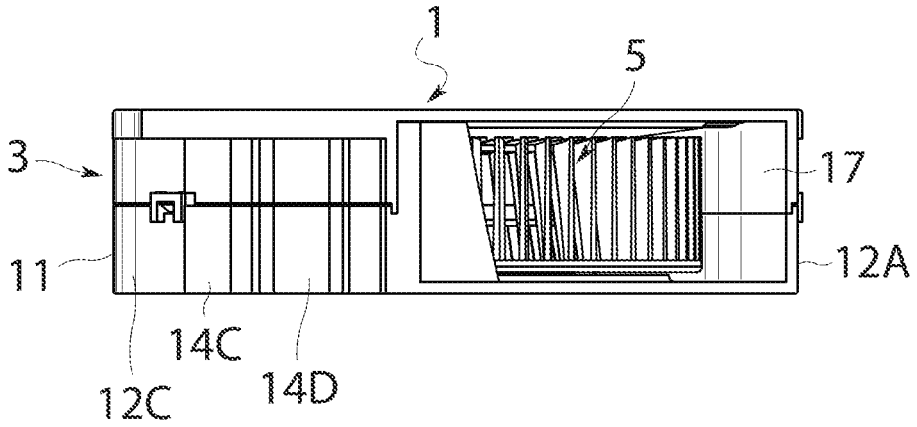
FIG. 4 is a side view of the centrifugal fan according to the first embodiment from which lead wires have been removed.
Figure 5A:
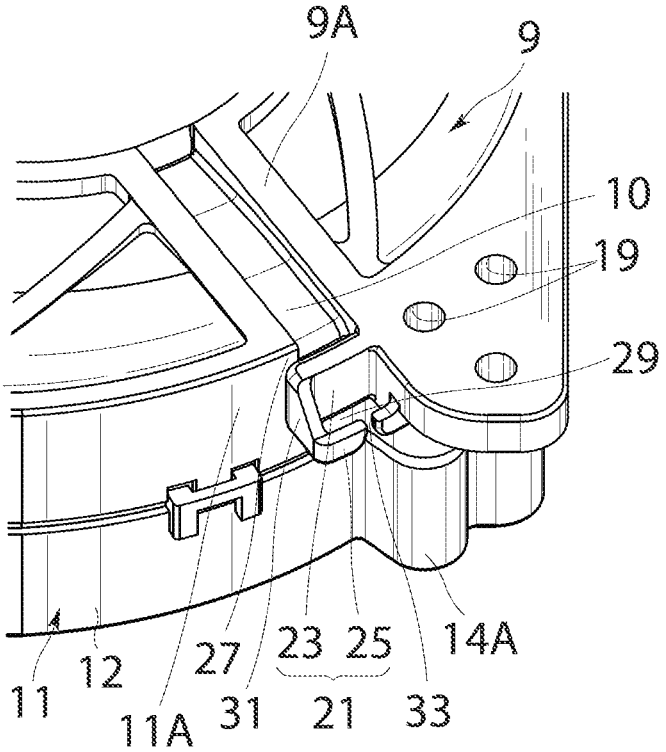
FIGS. 5A to 5D are each a partial enlarged view of a lead wire engaging structure as enlarged and seen from a plurality of directions.
Figure 5B:
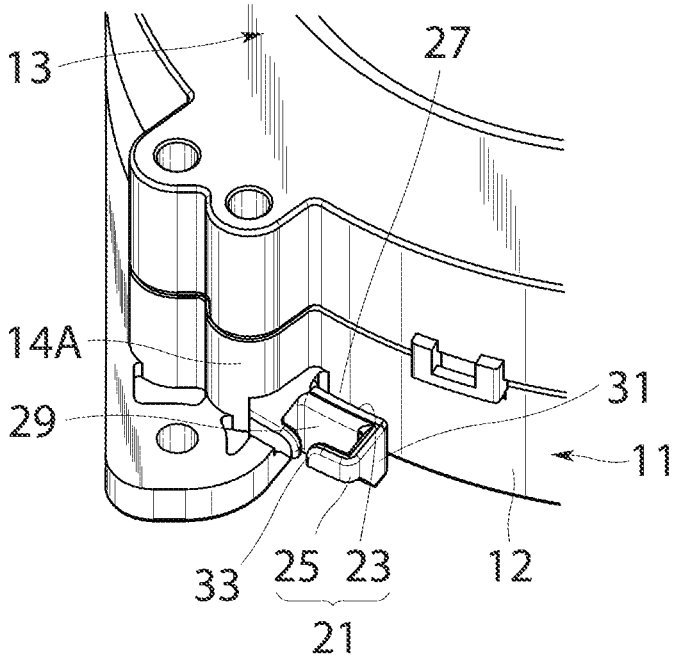
Figure 5C:
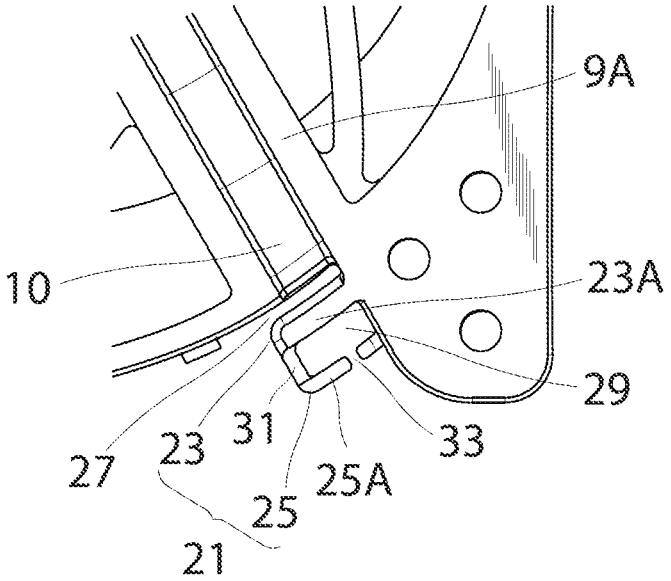
Figure 5D:
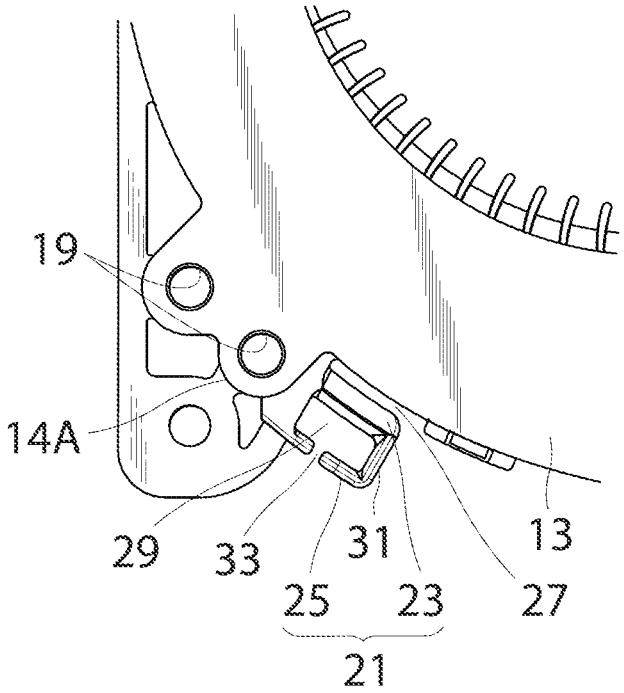
Figure 6A:
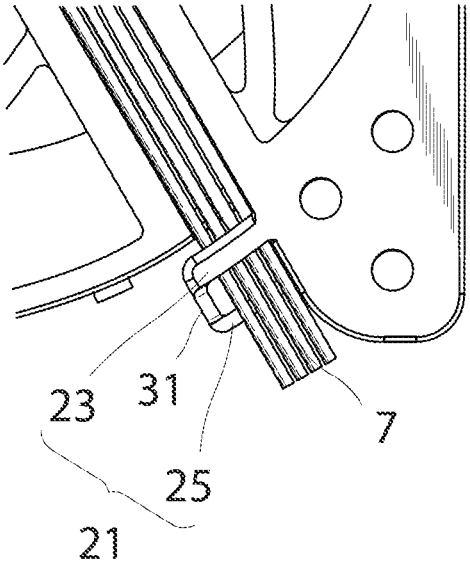
FIGS. 6A and 6B are each a partial enlarged view of the lead wire engaging structure at which lead wires are engaged.
Figure 6B:
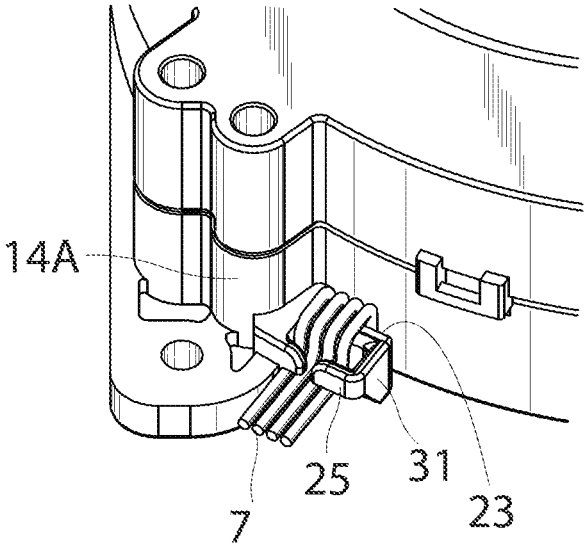
Figure 7:
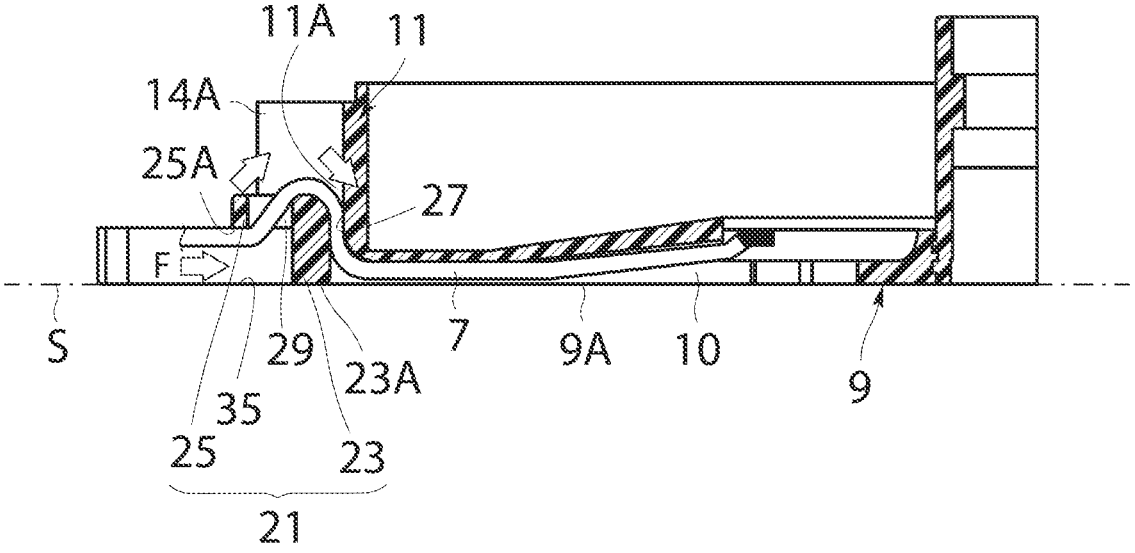
FIG. 7 illustrates the function of the lead wire engaging structure.

A plurality of electric apparatuses each including a lead wire engaging structure according to embodiments of the present invention will be described with reference to the drawings. FIG. 1 is a perspective view showing the back side of a centrifugal fan according to a first embodiment of the present invention. FIGS. 2 to 4 is a perspective view showing the back side, a perspective view showing the front side, and a side view, respectively, of the centrifugal fan according to the first embodiment from which lead wires have been removed. FIGS. 5A to 5D are each a partial enlarged view of a lead wire engaging structure as enlarged and seen from a plurality of directions. FIGS. 6A and 6B are each a partial enlarged view of the lead wire engaging structure at which lead wires 7 are engaged. FIG. 7 illustrates the function of the lead wire engaging structure. As shown in the drawings, a centrifugal fan 1 according to the embodiment includes a fan casing 3 serving as an electric apparatus casing, and an impeller 5 (FIGS. 3 and 4) fixed to a rotary shaft 6 of a motor (not shown), which is disposed inside the fan casing 3, to be rotatable. The fan casing 3 is molded from an insulating resin to be divided into two parts, and includes a first casing wall portion 9 from which four lead wires 7 having an insulating coating are led out, a second casing wall portion 11 continuously formed with the first casing wall portion 9 and extending in an intersecting direction intersecting (in the embodiment, orthogonally) the direction in which the first casing wall portion 9 extends, and a third casing wall portion 13 disposed opposite to the first casing wall portion 9. A suction port 15 is formed at the third casing wall portion 13, and a discharge port 17 is formed at the second casing wall portion 11. The impeller 5 includes a plurality of blades designed to suck air from the suction port 15 in the axial direction of the rotary shaft and discharge the air from the discharge port 17 after changing the direction of the air flow to a direction orthogonal to the axis of the rotary shaft 6 when the rotary shaft 6 of the motor rotates.

In the centrifugal fan 1, the second casing wall portion 11 includes first and second straight wall portions 12A and 12B continuously formed with the discharge port 17 and disposed opposite to each other with a predetermined gap therebetween, and an arcuate wall portion 12C continuously formed with the first and second straight wall portions 12A and 12B. A first portion of the arcuate wall portion 12C that is adjacent to one of the first and second straight wall portions 12A and 12B that is the longer, namely the first straight wall portion 12A, is integrally provided with a first mounting portion 14A, which corresponds to an extending portion, including two mounting screw through holes 19 each allowing passage of a mounting screw for fixing the fan casing 3 to an installation surface. The arcuate wall portion 12C is also integrally provided with second to fourth mounting portions 14B to 14D each located a predetermined distance away from the first mounting portion 14A in the circumferential direction. One or more mounting screw through holes 19 are formed in each of the second to fourth mounting portions 14B to 14D.

The first casing wall portion 9 includes a groove portion 10 formed to open toward an outer wall surface 9A of the first casing wall portion 9 and an outer wall surface 11A of the second casing wall portion 11 and to receive a part of the four lead wires 7. A lead wire engaging structure 21 is integrally provided to the first mounting portion 14A to face the groove portion 10. The configuration of the lead wire engaging structure 21 will be described below with reference to FIGS. 5A to 5D. The lead wire engaging structure 21 according to the present embodiment includes a first engaging portion 23 and a second engaging portion 25. One end of the first engaging portion 23 and one end of the second engaging portion 25 are integrally provided to the first mounting portion 14A integrally provided at the second casing wall portion 11. The first engaging portion 23 and the second engaging portion 25 are entirely located in a space located in an extending direction in which the second casing wall portion 11 extends with respect to an imaginary plane S (see FIG. 7) including the outer wall surface 9A of the first casing wall portion 9. The first engaging portion 23 and the second engaging portion 25 according to the embodiment each have the shape of a long and narrow plate extending in the peripheral direction along the second casing wall portion 11.

The first engaging portion 23 forms a first gap 27 between the first engaging portion 23 and the second casing wall portion 11, and holds the four lead wires 7 in the first gap 27 in cooperation with the second casing wall portion 11. The first gap 27 allows the four lead wires 7 to pass therethrough. The second engaging portion 25 forms a second gap 29 between the second engaging portion 25 and the first engaging portion 23. The second gap 29 allows the four lead wires 7 to pass therethrough. The other end portion of the first engaging portion 23 and the other end portion of the second engaging portion 25 are coupled to each other by a coupling portion 31. The second engaging portion 25 includes one slit 33 formed at a center area of the second engaging portion 25 and allowing one of the lead wires 7 to pass therethrough while the insulating coating of the one lead wire 7 is deformed by compression in the slit 33. The slit 33 enables the four lead wires 7 having passed through the first gap 27 to pass through the slit 33 to be inserted into the second gap 29. Therefore, the slit 33 is significantly effective if the lead wires 7 are long. Because the slit 33 is sized to allow one of the lead wires 7 to pass therethrough only while the insulating coating of the one lead wire 7 is deformed by compression in the slit 33, the four lead wires 7 inserted into the second gap 29 do not come out of the second gap 29 unless the lead wires 7 are intentionally pulled out through the slit 33.

In the embodiment, as shown in FIG. 7, the second engaging portion 25 is shaped such that a lead wire passage space 35 allowing the lead wires 7 to pass is defined between the second engaging portion 25 and the imaginary plane S including the outer wall surface 9A of the first casing wall portion 9. That is, the second engaging portion 25 is shaped such that an end surface 25A of the second engaging portion 25 on the bottom surface side is father than an end surface 23A of the first engaging portion 23 on the bottom surface side from the imaginary plane S. According to such structure, the lead wires 7 does not hinder installation of the centrifugal fan 1 in installing the centrifugal fan 1 such that the first casing wall portion 9 of the fan casing 3 contacts the installation surface (at the location at which the centrifugal fan 1 is to be installed). By forming the lead wire passage space 35 allowing the lead wires 7 to pass therethrough between the second engaging portion 25 and the imaginary plane S, in particular, the lead wires 7 extending out of the lead wire engaging structure 21 can be reliably prevented from hindering installation of the centrifugal fan 1.

In the lead wire engaging structure 21 according to the embodiment, as shown in FIGS. 6 and 7, the four lead wires 7 are bent at an angled portion between the first casing wall portion 9 and the second casing wall portion 11 and then routed to pass through the first gap 27 and then sequentially inserted into the second gap 29 from the slit 33 provided in the second engaging portion 25 to engage the four lead wires 7 at the fan casing 3. In the lead wire engaging structure 21, when the four lead wires 7 receive a force that presses the lead wires 7 in the longitudinal direction thereof (a force in the direction indicated by the arrow F in FIG. 7), portions of the lead wires 7 located in the second gap 29 are moved toward the second casing wall portion 11. Then, portions of the lead wires 7 located between the second gap 29 and the first gap 27 are brought into abutment with the second casing wall portion 11. The force presses the lead wires 7 against the second casing wall portion 11, but does not press out portions of the lead wires 7 held in the first gap 27 between the first engaging portion 23 and the second casing wall portion 11. Therefore, according to the lead wire engaging structure 21, the lead wires 7 are not raised even if the lead wires 7 receive a force in the direction indicated by an arrow F in FIG. 7.

Figure 8A:
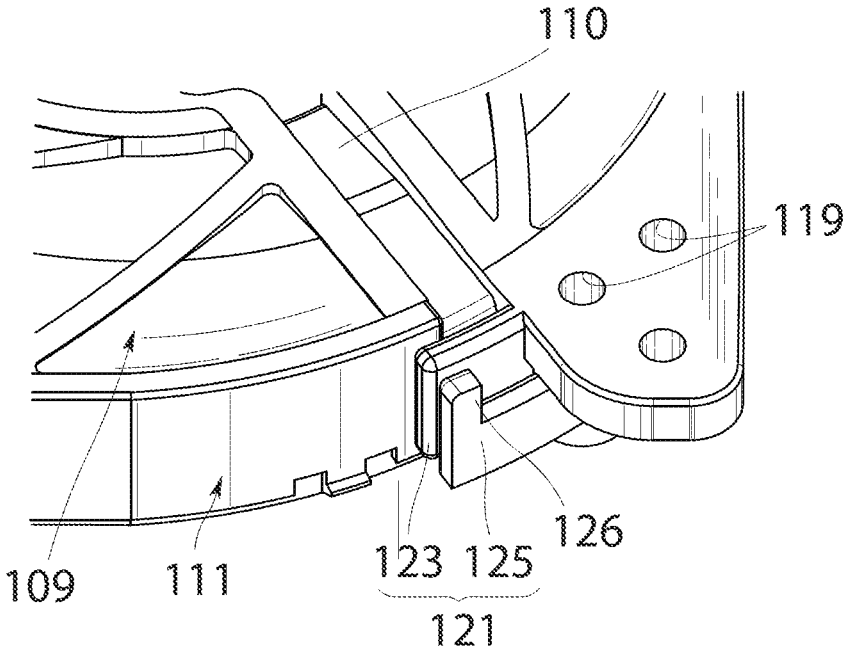
FIGS. 8A to 8C are each a partial enlarged view of a lead wire engaging structure according to a second embodiment of the present invention as enlarged and seen from a plurality of directions.
Figure 8B:
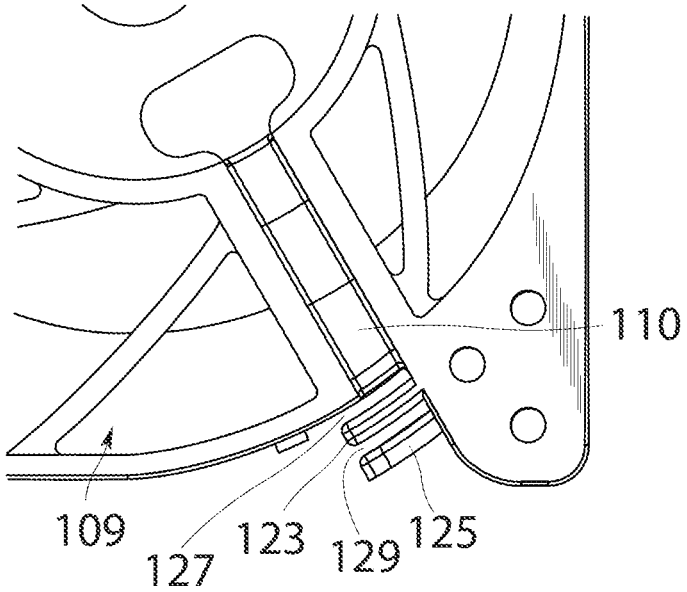
Figure 8C:
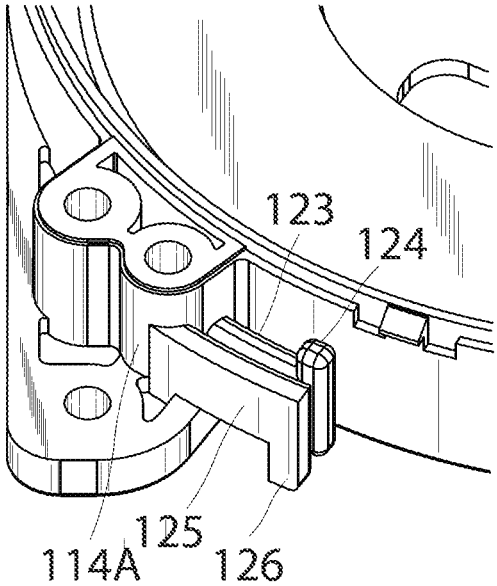
Figure 9A:
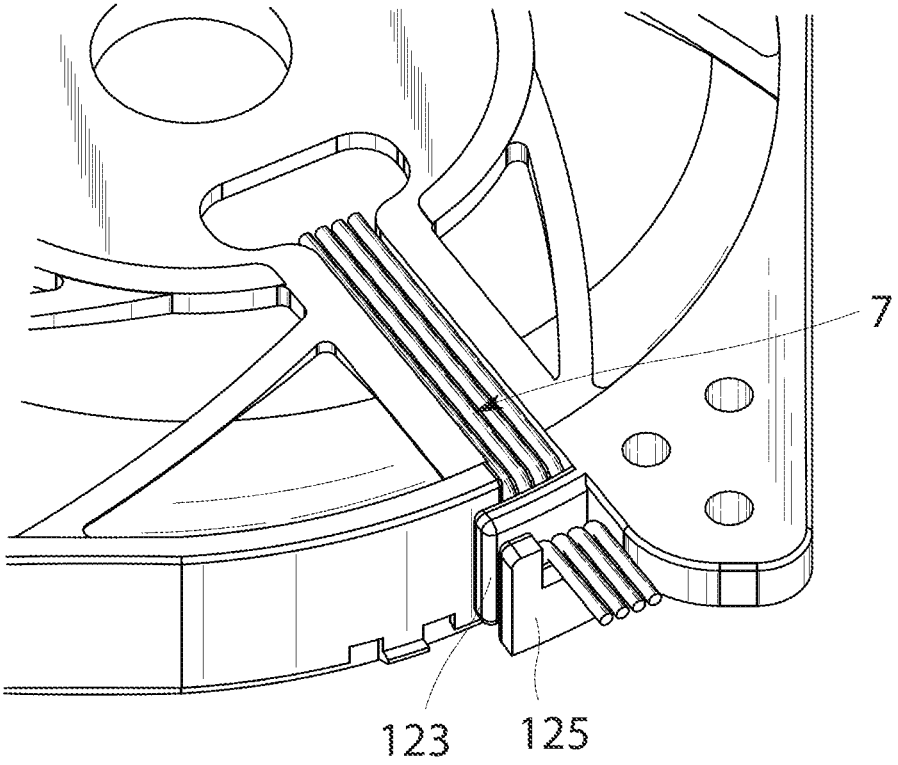
FIGS. 9A and 9B are each a partial enlarged view of the lead wire engaging structure of FIGS. 8A to 8C at which lead wires are engaged.
Figure 9B:
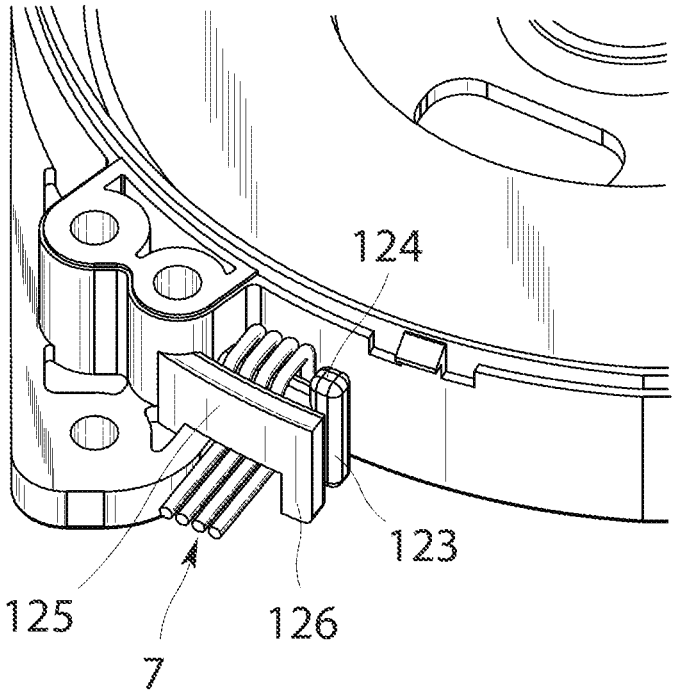

FIGS. 8A to 8C are each an enlarged perspective view of a lead wire engaging structure according to a second embodiment of the present invention. FIGS. 9A and 9B are each an enlarged perspective view in which lead wires are engaged in the second embodiment. In the figures, components similar to the components in the first embodiment shown in FIGS. 1 to 7 are denoted by reference numerals obtained by adding 100 to the reference numerals affixed to their counterparts in FIGS. 1 to 7. In the second embodiment, the second casing wall portion 111 is provided with a first mounting portion 114A, which forms an extending portion, to which one end of the first engaging portion 123 and one end of the second engaging portion 125 are fixed. In the embodiment, the other end portion of the first engaging portion 123 and the other end portion of the second engaging portion 125 each act as a free end portion. Thus, the first gap 127 and the second gap 129 are open in the direction in which the second casing wall portion 111 extends and in the direction opposite to the first mounting portion 114A. A projection 124 extending in the direction in which the second casing wall portion 111 extends is integrally provided at the other end portion of the first engaging portion 123. A projection 126 extending in the direction opposite to the direction in which the second casing wall portion 111 extends is integrally provided at the other end portion of the second engaging portion 125. In the embodiment, after the lead wires 7 pass through the first gap 127, the lead wires 7 are inserted into the second gap 129 between the first engaging portion 123 and the second engaging portion 125 from a space between the free end portions of the first and second engaging portions 123 and 125 while the lead wires 7 are prevented from slipping out of the first gap 127. As shown in FIGS. 9A and 9B, the projections 124 and 126 engage the lead wires 7 to prevent the lead wires 7 from slipping out of the first and second gaps 127 and 129.

Figure 10A:
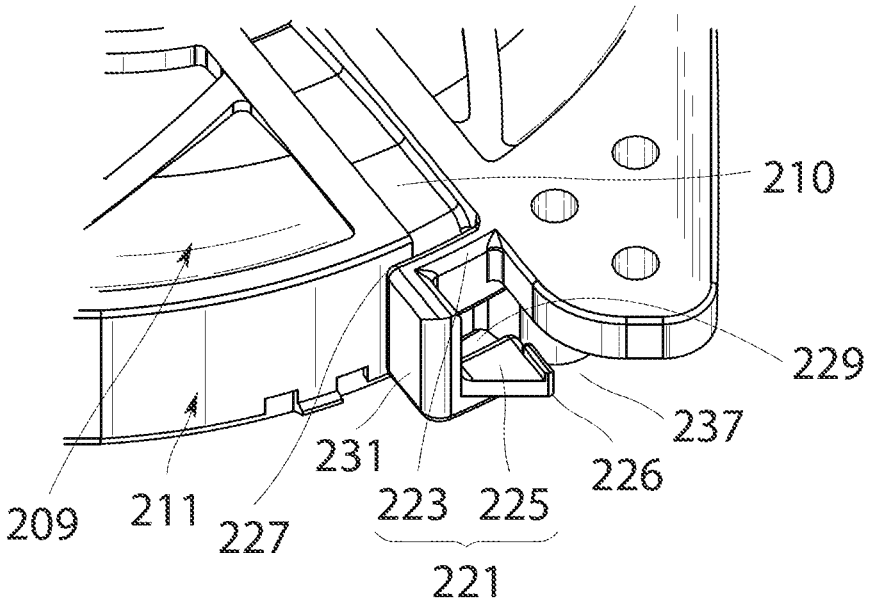
FIGS. 10A to 10C are each a partial enlarged view of a lead wire engaging structure according to a third embodiment of the present invention as enlarged and seen from a plurality of directions.
Figure 10B:
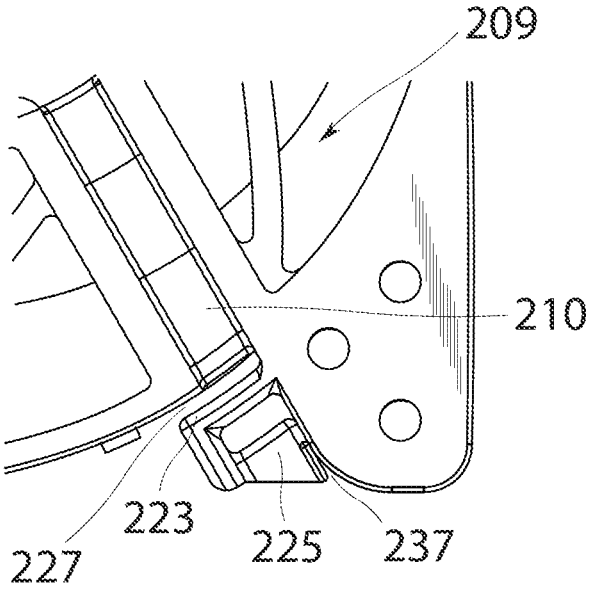
Figure 10C:
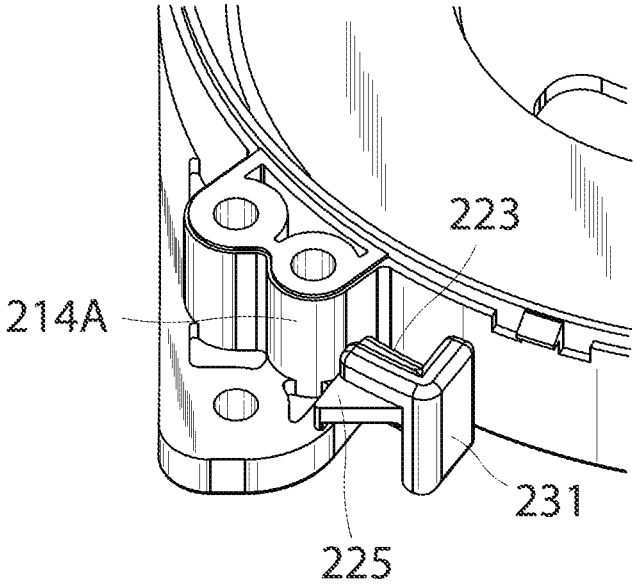
Figure 11A:
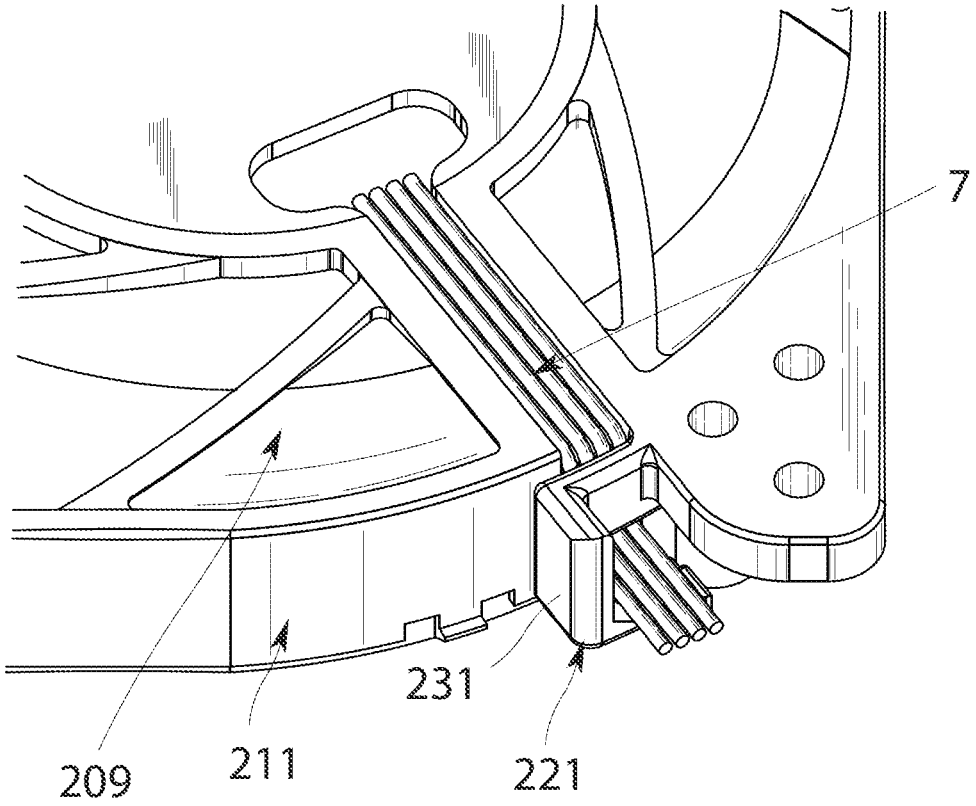
FIGS. 11A and 11B are each a partial enlarged view of the lead wire engaging structure of FIGS. 10A to 10C at which lead wires are engaged.
Figure 11B:
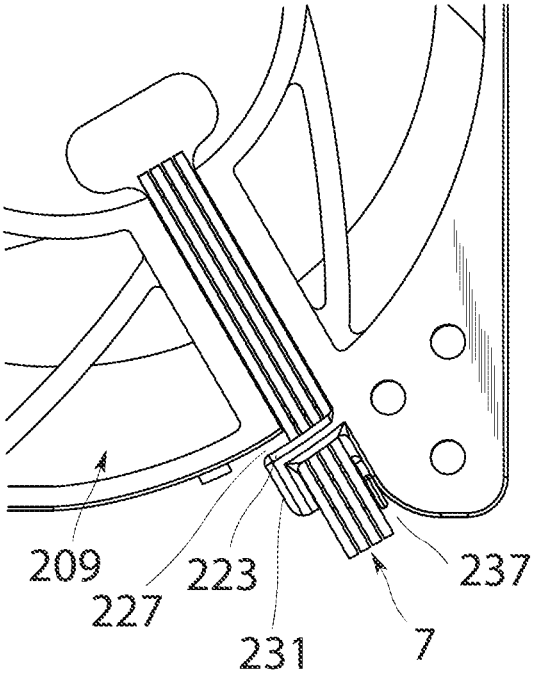

FIGS. 10A to 10C are each an enlarged perspective view of a lead wire engaging structure according to a third embodiment of the present invention. FIGS. 11A and 11B are each an enlarged perspective view in which lead wires are engaged in the third embodiment. In the figures, components similar to the components in the first embodiment shown in FIGS. 1 to 7 are denoted by reference numerals obtained by adding 200 to the reference numerals affixed to their counterparts in FIGS. 1 to 7. In the third embodiment, the second casing wall portion 211 is provided with a first mounting portion 214A, which forms an extending portion, to which one end of the first engaging portion 223 is fixed. In the embodiment, the other end portion of the first engaging portion 223 and the other end portion of the second engaging portion 225 are coupled to each other by a coupling portion 231. One end of the second engaging portion 225 acts as a free end portion, and a third gap 237 is formed between one end of the second engaging portion 225 and the second casing wall portion 211. The third gap 237 allows the lead wires 7 to pass.

The second engaging portion 225 according to the embodiment has a triangular shape, and a projection 226 extending in the direction opposite to the direction in which the second casing wall portion 211 extends is integrally provided at the other end of the second engaging portion 225. In the embodiment, after the one or more lead wires 7 pass through the first gap 227, the lead wires 7 are inserted into the second gap 229 between the first engaging portion 223 and the second engaging portion 225 through the third gap 237. Because the third gap 237 is formed between the first mounting portion 214A and the second engaging portion 225, the lead wires 7 inserted into the first gap 227 do not slip out of the first gap 227 during an engaging operation.

In the embodiments described above, the present invention is applied to a centrifugal fan. It is a matter of course, however, that the lead wire engaging structure according to the present invention may be applied to any electric apparatus other than centrifugal fans that includes an electric apparatus casing including a first casing wall portion along which lead wires extend and a second casing wall portion extending from the first casing wall portion in an intersecting direction intersecting the direction in which the first casing wall portion extends.

While certain features of the invention have been described with reference to example embodiments, the description is not intended to be construed in a limiting sense. Various modifications of the example embodiments, as well as other embodiments of the invention, which are apparent to persons skilled in the art to which the invention pertains, are deemed to lie within the spirit and scope of the invention.

What is claimed is:

1. A lead wire engaging structure configured to engage one or more lead wires at an electric apparatus casing including a first casing wall portion from which the one or more lead wires are led out and a second casing wall portion continuously formed with the first casing wall portion and extending in an intersecting direction intersecting a direction in which the first casing wall portion extends, the one or more lead wires having an insulating coating and being engaged at the second casing wall portion, the lead wire engaging structure comprising:

a first engaging portion fixed to the electric apparatus casing to form a first gap between the first engaging portion and the second casing wall portion and to engage the one or more lead wires in cooperation with the second casing wall portion, the first gap allowing the one or more lead wires to pass therethrough; and a second engaging portion fixed to the electric apparatus casing or the first engaging portion to form a second gap between the second engaging portion and the first engaging portion, the second gap allowing the one or more lead wires to pass therethrough, wherein the one or more lead wires are bent at an angled portion between the first casing wall portion and the second casing wall portion and then routed to pass through the first gap and then through the second gap to engage the one or more lead wires at the electric apparatus casing;

the first casing wall portion includes a groove portion formed to open toward an outer wall surface of the first casing wall portion and an outer wall surface of the second casing wall portion and to receive a part of the one or more lead wires;

the first engaging portion and the second engaging portion are entirely located in a space located in an extending direction in which the second casing wall portion extends with respect to an imaginary plane including the outer wall surface of the first casing wall portion, and are shaped such that a lead wire passage space allowing the one or more lead wires to pass therethrough is defined between the second engaging portion and the imaginary plane;

the second casing wall portion includes an extending portion to which one end portion of the first engaging portion and one end portion of the second engaging portion are fixed;

the other end portion of the first engaging portion and the other end portion of the second engaging portion are coupled to each other by a coupling portion; and the second engaging portion includes one slit formed at a center area of the second engaging portion and allowing one of the lead wires to pass therethrough while the insulating coating of the one lead wire is deformed by compression in the slit, the undeformed diameter of the one lead wire is larger than a size of the slit, wherein the second engaging portion is rigid.

2. An electric apparatus comprising:

an electric apparatus casing including:

a first casing wall portion having an outer wall surface to be disposed in contact with an installation surface;

a second casing wall portion continuously formed with the first casing wall portion and extending in an intersecting direction intersecting a direction in which the first casing wall portion extends; and a third casing wall portion formed continuously with the second casing wall portion and disposed opposite to the first casing wall portion;

an electric device disposed in the electric apparatus casing;

one or more lead wires having an insulating coating and being connected to the electric device and extending out of the first casing wall portion;

a groove portion formed to open toward an outer wall surface of the first casing wall portion and an outer wall surface of the second casing wall portion and to receive a part of the one or more lead wires; and a lead wire engaging structure provided to the second casing wall portion to engage the one or more lead wires extending out of the groove portion, the lead wire engaging structure comprising:

a first engaging portion fixed to the second casing wall portion to form a first gap between the first engaging portion and the second casing wall portion and to engage the one or more lead wires in cooperation with the second casing wall portion, the first gap allowing the one or more lead wires to pass therethrough; and a second engaging portion fixed to the second casing wall portion or the first engaging portion to form a second gap between the second engaging portion and the first engaging portion, the second gap allowing the one or more lead wires to pass therethrough, wherein the one or more lead wires are bent at an angled portion between the first casing wall portion and the second casing wall portion and then routed to pass through the first gap and then through the second gap to engage the one or more lead wires;

the first engaging portion and the second engaging portion are shaped not to hinder attachment of the electric apparatus to the installation surface with the outer wall surface of the first casing wall portion in contact with the installation surface, and are shaped such that a lead wire passage space allowing the one or more lead wires to pass therethrough is defined between the second engaging portion and the installation surface;

the second casing wall portion includes an extending portion to which one end portion of the first engaging portion and one end portion of the second engaging portion are fixed;

the other end portion of the first engaging portion and the other end portion of the second engaging portion are coupled to each other by a coupling portion; and the second engaging portion includes one slit formed at a center area of the second engaging portion and allowing one of the lead wires to pass therethrough while the insulating coating of the one lead wire is deformed by compression in the slit, the undeformed diameter of the one lead wire is larger than a size of the slit, wherein the second engaging portion is rigid.

3. The electric apparatus according to claim 2, wherein:

the electric apparatus is a centrifugal fan including a suction port formed in the third casing wall portion of the electric apparatus casing and a discharge port formed in the second casing wall portion;

the second casing wall portion includes first and second straight wall portions continuously formed with the discharge port and disposed opposite to each other with a predetermined gap therebetween, and an arcuate wall portion continuously formed with the first and second straight wall portions;

a first portion of the arcuate wall portion that is adjacent to one of the first and second straight wall portions that is the longer is integrally provided with a mounting portion including one or more screw holes each allowing passage of a mounting screw for fixing the electric apparatus casing to the installation surface; and the first and second engaging portions are integrally provided to the mounting portion.

* * * * *